United States Patent [19]

Morokawa et al.

[11] 3,971,012

[45] July 20, 1976

[54] DISPLAY DEVICE EMPLOYING SPECIAL-PURPOSE MONOGRAMS

[75] Inventors: Shigeru Morokawa; Katsuo Nishimura; Yasushi Nomura, all of Tokorozawa, Japan

[73] Assignee: Citizen Watch Co., Ltd., Tokyo, Japan

[22] Filed: Feb. 25, 1974

[21] Appl. No.: 445,625

[30] Foreign Application Priority Data

June 18, 1973 Japan ..... 48-68438

[52] U.S. Cl. ..... 340/336; 58/153; 58/50 R; 340/324 R

[51] Int. Cl.² ..... G09F 9/32

[58] Field of Search ..... 340/324 R, 324 M, 336; 58/17, 50 R, 50 A, 153

[56] References Cited

UNITED STATES PATENTS

| | | | |
|---|---|---|---|
| 1,168,084 | 1/1916 | Lowenstein | 340/336 |
| 1,965,874 | 7/1934 | Appold | 340/336 |
| 2,735,038 | 2/1956 | Hancock | 340/336 |
| 3,678,678 | 7/1972 | Macedo | 58/17 |
| 3,691,755 | 9/1972 | Girard | 58/50 R |
| 3,738,099 | 6/1973 | Tanaka | 58/50 R |

*Primary Examiner*—Marshall M. Curtis
*Attorney, Agent, or Firm*—Ernest G. Montague; Karl F. Ross; Herbert Dubno

[57] ABSTRACT

A photoelectric display device having an electrically controlled optical means for indicating one of the 7 days of the week by means of a combination of two letters selected from alphabetical letters is disclosed. The device comprises a first display element composed of a plurality of segments arranged in such pattern that all of the letters positioned in the first place of the seven combinations expressing the 7 days of the week can be indicated, and a second display element composed of a plurality of segments arranged in such pattern that all of the letters positioned in the second place of the above mentioned seven combinations can be indicated. Each segment of each of the display elements is electrically controlled to indicate any desired days of the week.

3 Claims, 48 Drawing Figures

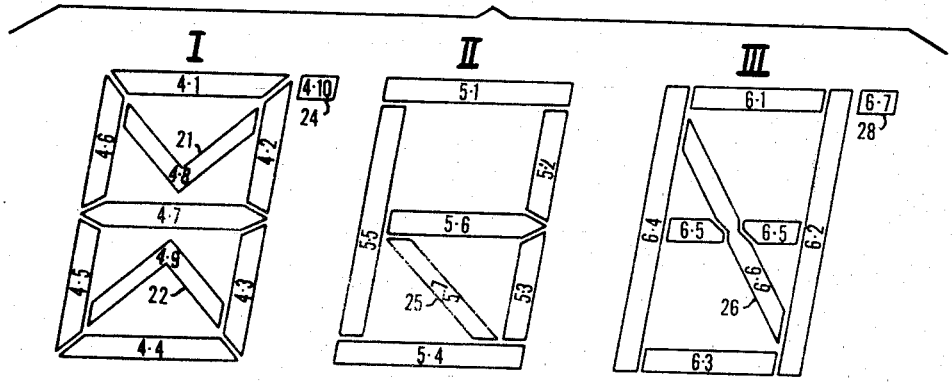
FIG. 6a
FIG. 6b
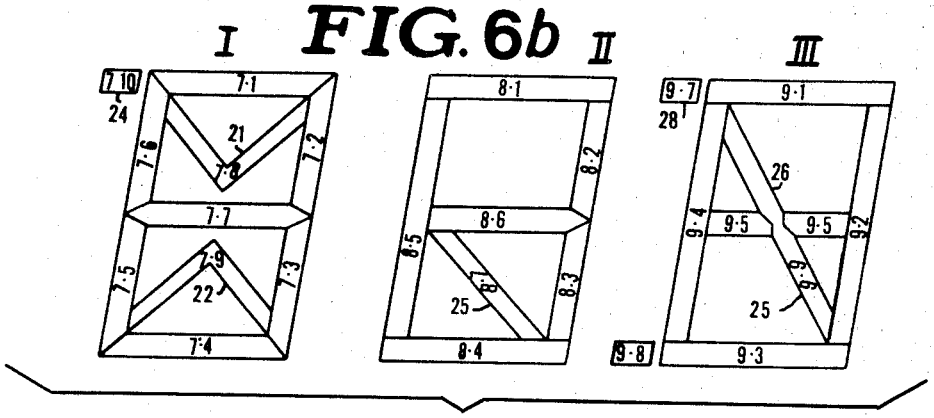

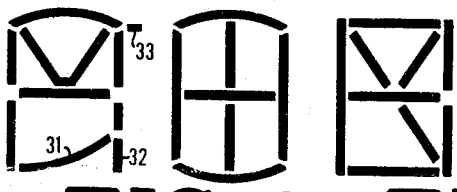
FIG. 10a
FIG. 11b
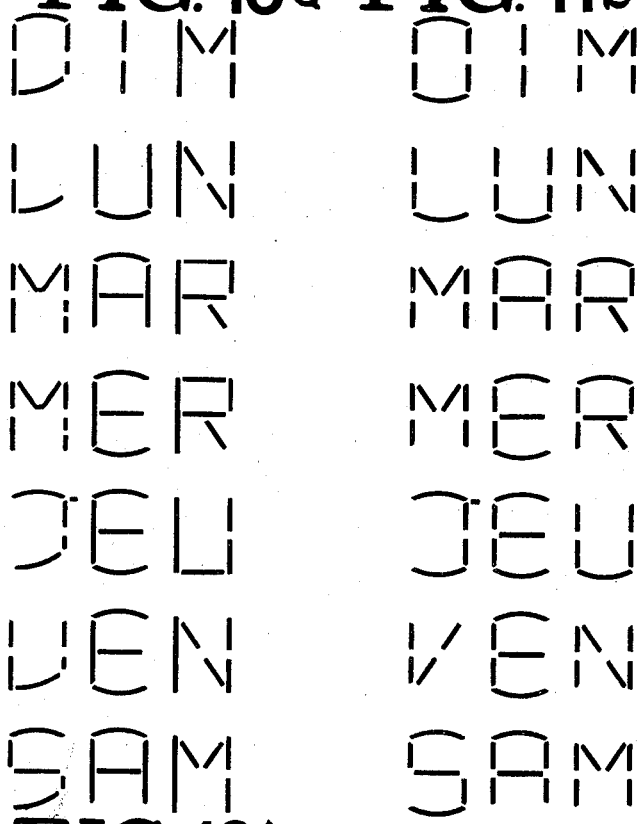
FIG. 10b
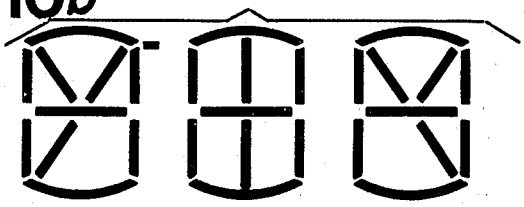
FIG. 11a

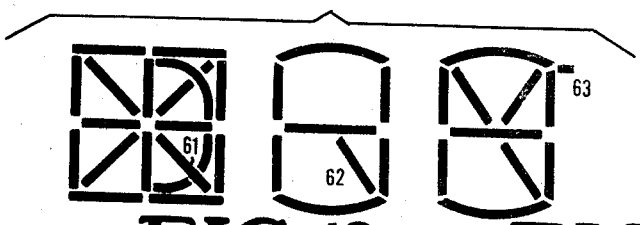
FIG. 13a
FIG. 17b
SUN SON
MON MON
TUE DIE
WED MIT
THU DON
FRI FRE
SAT SAM
FIG. 13b
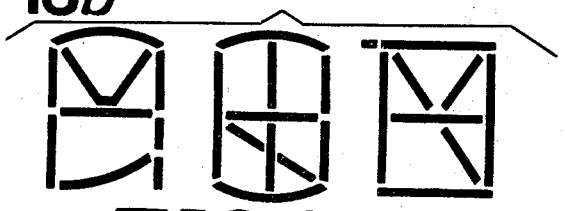
FIG. 17a

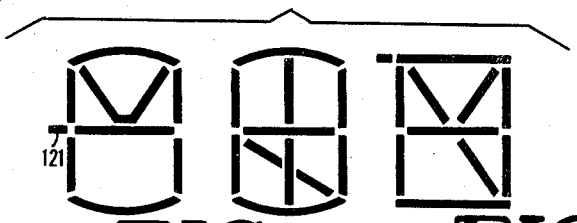
FIG. 18a
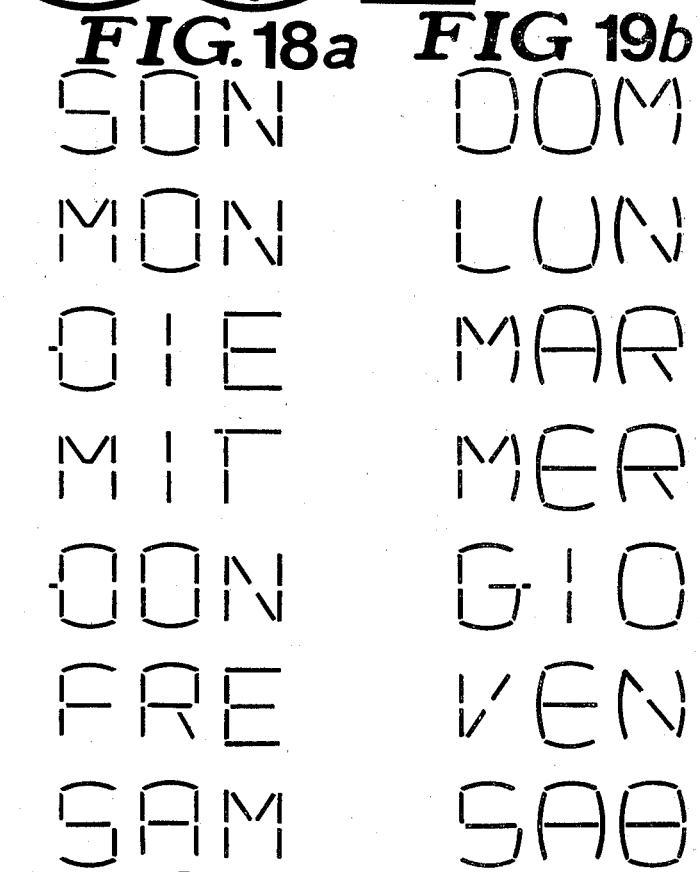
FIG. 19b
FIG. 18b
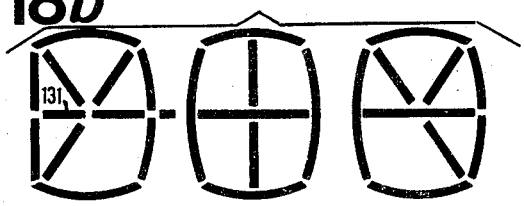
FIG. 19a

FIG. 20a
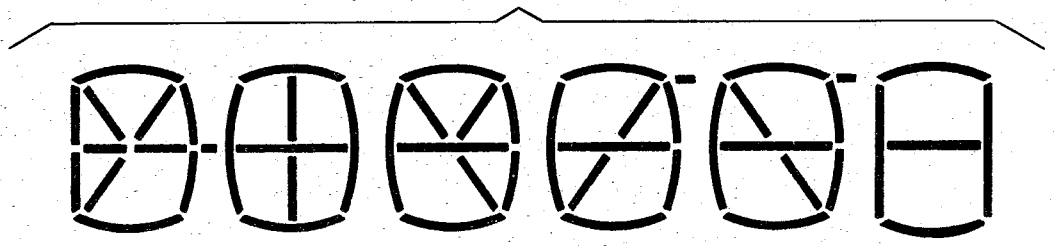
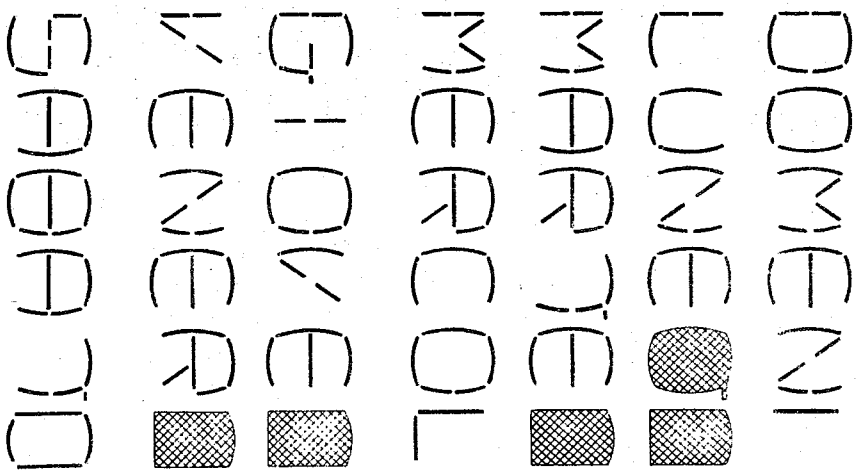
FIG. 20b

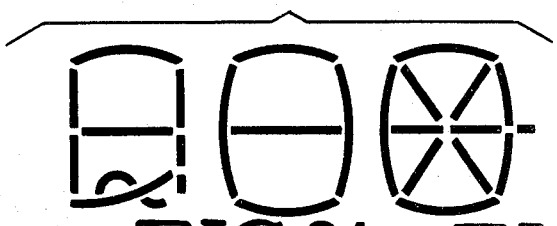
FIG. 21a
FIG 22b
DOM DOM
SEG LUN
TER MAR
QUA MIE
QUI JUE
SEX VIE
SAB SAB
FIG. 21b
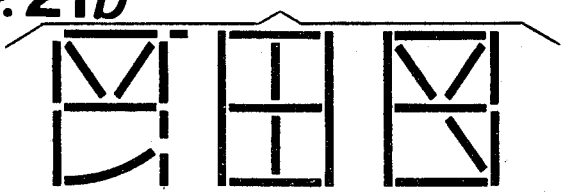
FIG. 22a

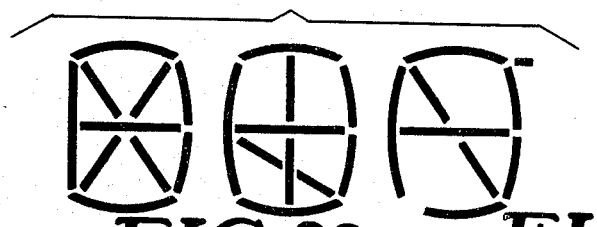
FIG. 23a
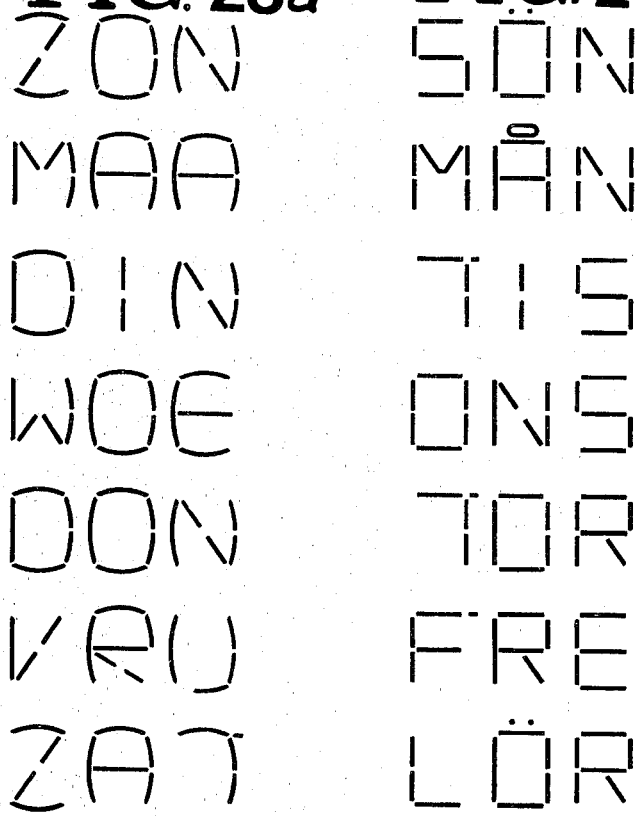
FIG. 23b
FIG. 24b
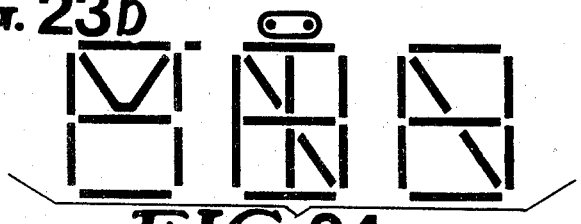
FIG. 24a

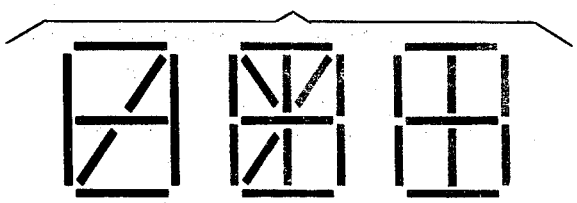
FIG. 25a
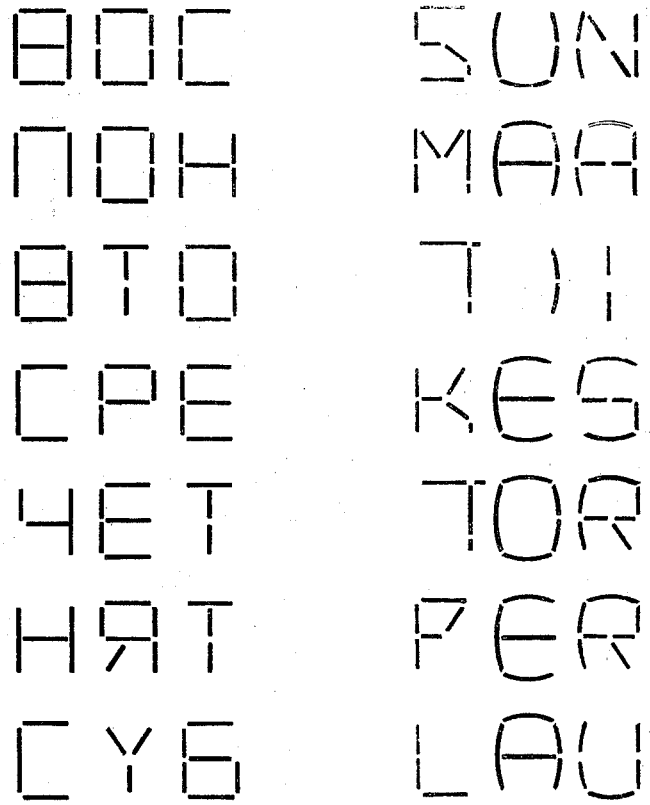
FIG. 25b
FIG. 26b
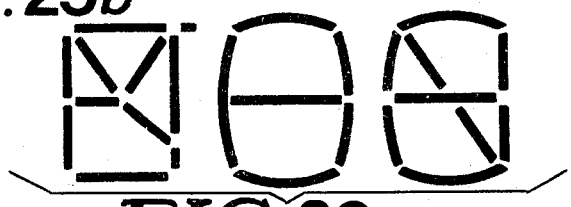
FIG. 26a

DISPLAY DEVICE EMPLOYING SPECIAL-PURPOSE MONOGRAMS

This invention relates to a photoelectric display device having segments which can indicate the 7 days of the week in various national languages abbreviated in one to several alphabetical letters.

As such photoelectric display device for indicating the days of the week, a display mechanism for use in timepieces has heretofore been proposed which is provided with an electronic optical element and is electronically controlled. A feature of such conventional display mechanism is the provision of date symbols (from MON to SUN), each of these date symbols being converted into code by means of one electric control signal, as described in German laid open Specification No. 2,153,637.

In such a display mechanism, provision must be made of date symbols beforehand on a display surface as shown in FIG. 1. Thus, it is impossible to provide a simple display surface as for days of the week indicated by a conventional reflex or drum-type electromechanical mechanism as shown in FIG. 2. The customary photoelectric display device has the disadvantage that not only the display surface is complex, but also a space problem arises when the display device indicating the days of the week is applied to a wrist watch or the like having an extremely small display surface.

A dot type photoelectric display device has also been proposed. In this conventional display device, a body composed of 35 dots is required for at least one letter in order to indicate the week days in various national languages; alphabetical letters and an electric control signal are required for every one dot and, as a result, difficulties arise in the construction of a time-counter circuit and in the connection between the time-counter circuit and the display body.

In order to obviate such difficulties with the display design, display space and connection with the time-counter circuit, it would appear desirable to indicate the days of the week with alphabetical letters in various national languages by successively illuminating and extinguishing a comparatively small number of display segments.

With the aid of the display segments it has heretofore been proposed to indicate the days of the week in English composed of two alphabetical letters by means of two display bodies 11, 12 each consisting of 14 display segments as shown in FIG. 3. In such conventional display device, the display segments are constructed such that one display body can indicate 24 alphabetical letters A, B, . . . Z.

As a result, this kind of conventional display device has the disadvantage that the number of the display segments becomes large, that the letters indicated are not in natural form, and that difficulties arise in the display design, display space and connections between the display segments and the time-counter circuit.

For indicating the days of the week in alphabetical letters, all of the alphabetical letters are not required. Thus, in English, all of the days, SUN, MON, TUE, WED, THU, FRI and SAT can be indicated by a first display segment S, M, T, W and F, a second display segment U, O, E, H, R and A, and a third display segment N, E, D, U, I and T, as shown in FIG. 4. The display element is understood to mean an assembly of segments indicating one numerical figure or one alphabetical letter. If the segments are suitably designed in shape and combination, it might be conceivable to indicate the days of the week in letters having natural forms by means of a comparatively small number of segments.

A user of a timepiece which can indicate the days of the week is not so much or so often required to know what day it is as what time of day it is. Accordingly, it is normally to cause the same display segment to indicate the time and also to indicate the days of the week, if necessary. Such display device must provide a display element which can indicate both the numerical figures and the alphabetical letters.

As described above, all of the alphabetical letters are not required to indicate the days of the week. In order to indicate the times and days, it is sufficient to provide alphabetical letters required for indicating all of the numerical digits 0, 1, . . . 9 and all the days of the week. Thus, it is conceivable that a comparatively small number of segments can furnish an indication of the numerical figures and the alphabetical letters in their natural forms.

Similarly, it is conceivable that provision may be made of a comparatively small number of segments so constructed that changeover between at least two national languages for indicating the days of the week is possible.

An object of the invention is to provide a photoelectric display device which can indicate in various national languages the days of the week abbreviated in one to several alphabetical letters in natural letter form by means of a comparatively small number of segments, and which can eliminate a difficult problem encountered with conventional display devices with respect to display design, display space and time-counter circuit connection.

Another object of the invention is to provide a photoelectric display device which can indicate alphabetical letters necessary for expressing the numerical digits 0, 1, . . . 9 and the days of the week with the aid of the same display element, and which can effect changeover between hours, minutes or seconds and the days of the week, and indicate if required either the hours, minutes or seconds or the days of the week with the aid of the same display element.

A further object of the invention is to provide a photoelectric display device which can effect changeover in at least two national languages for indicating the days of the week.

A still further object of the invention is to provide a photoelectric display device which can photoelectrically modulate and indicate a given day of the week in a manner distinguishing it from the other 6 days of the week.

The invention will now be described in greater detail with reference to the accompanying drawing wherein.

Figure 6C:
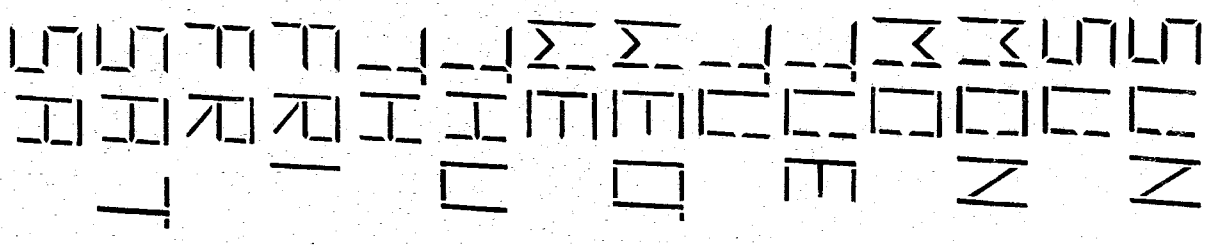
Figure 6D:
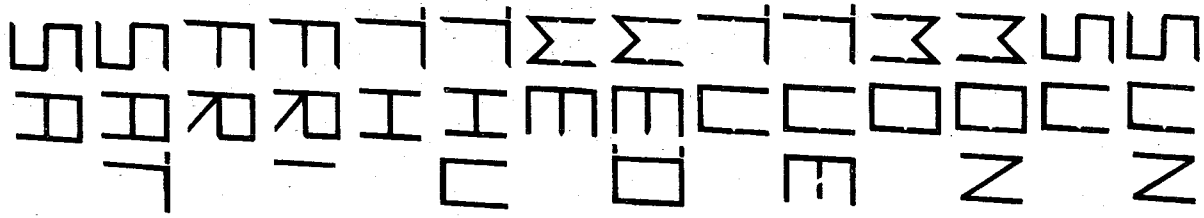
Figure 7:
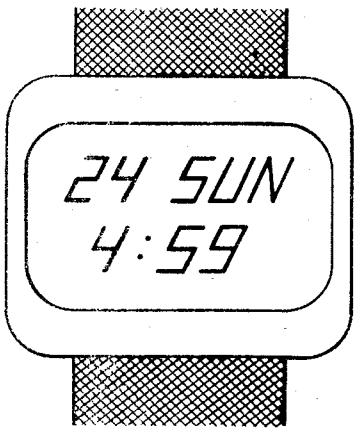
Figure 9:
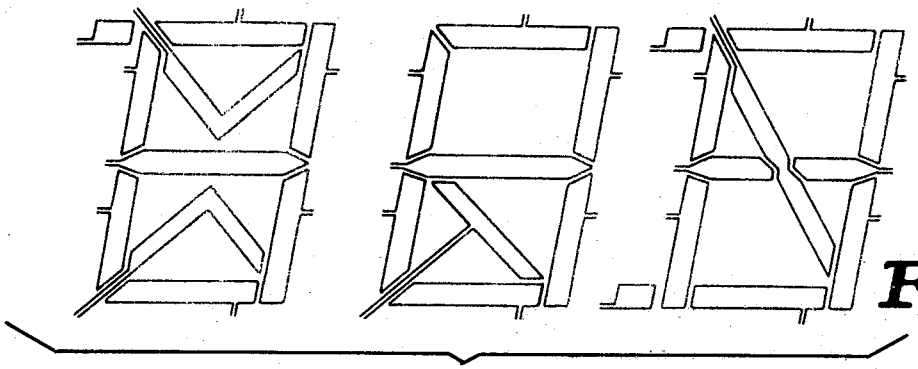
Figure 8A:
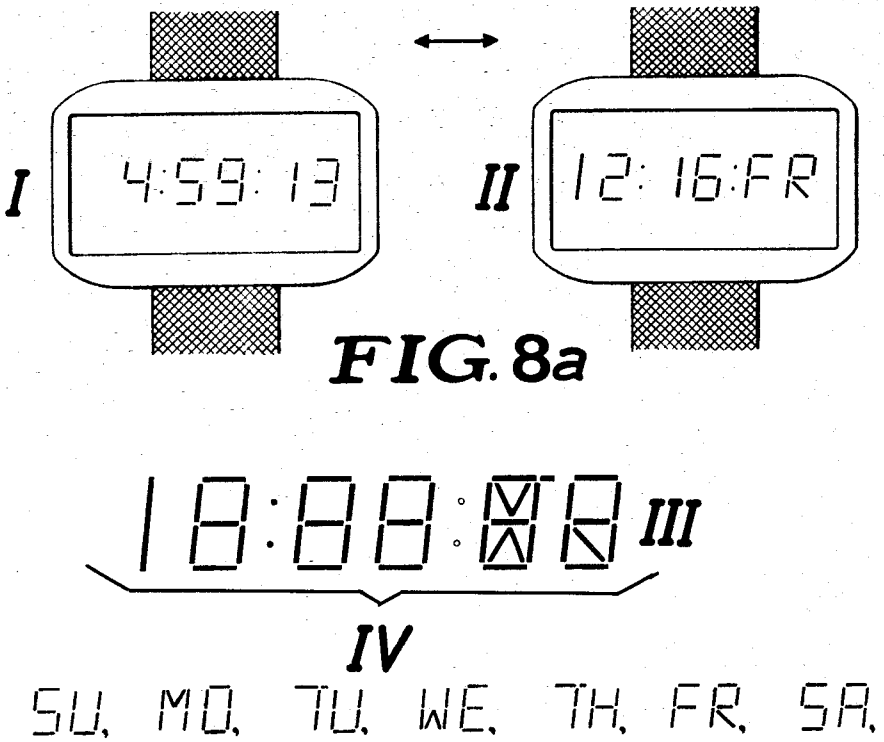
Figure 12A:
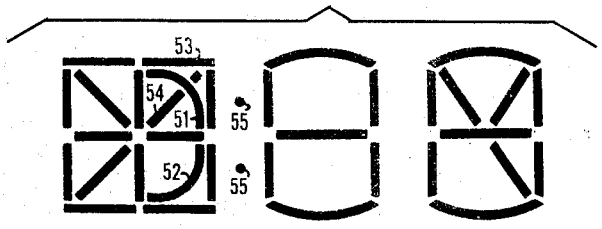
Figure 14A:
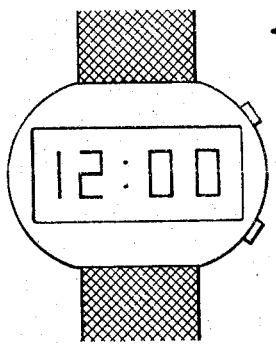
Figure 14B:
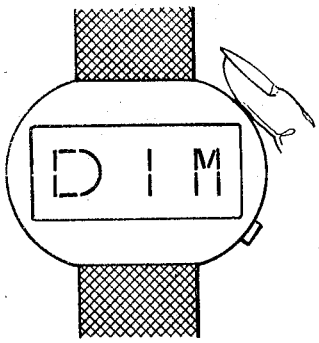
Figure 15:
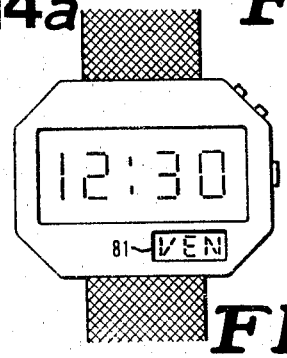

FIGS. 6*a* and *b* show embodiments according to the invention;

FIG. 7 shows a wrist watch which makes use of the invention;

FIGS. 8*a*, *b* and *c* illustrate the operation of the wrist watch which makes use of the invention;

FIG. 9 shows an embodiment of the electrode arrangement of the liquid-crystal cell according to the invention;

FIGS. 10 to 13, FIGS. 17 to 19 and FIGS. 21 to 26 show the display bodies of the display device according to the invention for indicating the days of the week in various national languages in abbreviated alphabetical letters by a reference letter *a*, respectively, and examples of the days of the week indicated by a reference letter *b*, respectively;

FIGS. 10*a* and *b* show the days of the week indicated in French;

FIGS. 11*a* and *b* show the days of the week indicated in French which can be changed over into the numerical digits;

FIGS. 12*a*, *b* and *c* show the days of the week indicated in French which can be changed over into the times;

FIGS. 13*a* and *b* show the days of the week indicated in English which can be changed over into those indicated in French and into the numerical digits;

FIGS. 14*a*, 14*b*, 15, 16*a* and 16*b* show various applications of the invention to a wristwatch;

FIGS. 17*a* and *b* show the days of the week indicated in German;

FIGS. 18*a* and *b* show the days of the week indicated in German which can be changed over into the numerical digits;

FIGS. 19*a* and *b* show the days of the week indicated in Italian;

FIGS. 21*a* and *b* show the days of the week indicated in Portuguese;

FIGS. 22*a* and *b* show the days of the week indicated in Spanish;

FIGS. 23*a* and *b* show the days of the week indicated in Dutch;

FIG. 24 shows the days of the week indicated in Swedish;

FIGS. 25*a* and *b* show the days of the week indicated in Russian;

FIGS. 26*a* and *b* show the days of the week indicated in Finnish;

FIGS. 14 to 16 show embodiments of the wrist watch which make use of the photoelectric display device according to the invention, respectively; and FIGS. 20*a* and *b* show the days of the week indicated in Italian abbreviated in four to six alphabetical letters, the display body composed of six letters being shown as an example.

In FIGS. 6 to 9 are shown examples of the days of the week indicated in English in abbreviated alphabetical letters based on the invention. A feature of these examples is the provision of the following three display bodies.

A first array of display segments is composed of a double quadrilateral superimposed one upon the other, the intermediate side being common to both the quadrilaterals; As shown in FIG. 5I, a V-shaped first segment 21 is inserted into the upper quadrilateral, an inverted V-shaped second segment 22 is inserted into the lower quadrilateral, and a third segment 24 extends rightwardly from the upper side of the upper quadrilateral as shown by a segment 4–10 in FIG. 6*a* I or extends leftwardly from the upper side of the upper quadrilateral as shown by a segment 7–10 in FIG. 6*b* I.

The first array of display segments constructed as described above is capable of indicating all of the numerical digits and alphabetical letters S, M, T, W and F.

Figure 5:
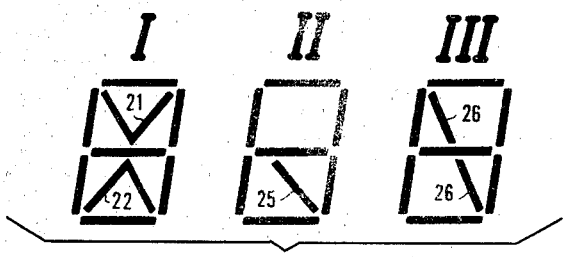
FIG. 5 shows segments for explaining the invention.

In FIG. 5 II is shown a second array of display element composed a double quadrilateral superimposed one upon the other, the intermediate side being common to both the quadrilaterals, and a fourth segment 25 inclined downwardly toward the right and inserted into the lower side quadrilateral. The second array of display segments cnstructed as above described is capable of indicating all of the numerical digits and alphabetical letters U, O, E. H, R and A. If it is not necessary to indicate the numerical digits, the left two segments may be replaced by a common segment 5—5 as shown in FIG. 6*a* II or a common segment 5—5 as shown in FIG. 6*b* II.

In FIG. 5 II is shown a third array of display segments composed of a double quadrilateral superimposed one upon the other, the intermediate side being common to both quadrilaterals, and a fifth segment 26 inclined downwardly toward the right and inserted into the upper and lower side quadrilaterals, respectively; and a sixth segment 28 extends rightwardly from the upper side of the upper quadrilateral as shown by a segment 6–7 in FIG. 6*a* III or leftwardly from the upper side of the upper quadrilateral as shown by a segment 9–7 in FIG. 6*b* III. The third array of display segments constructed as above described is capable of indicating all of the numerical digits and alphabetical letters N, D, U, I and T. This third array is omitted if indicating the week days by two alphabetical letters.

To the above described array of three display segments may be added other segments for the purpose of improving the forms of the alphabetical letters. In addition, it is preferable to add a segment extending rightwardly from the common intermediate side of the double quadrilaterals superimposed one upon the other in order to improve the form of the numerical digit 4. These modifications are also covered by the invention.

Figure 1:
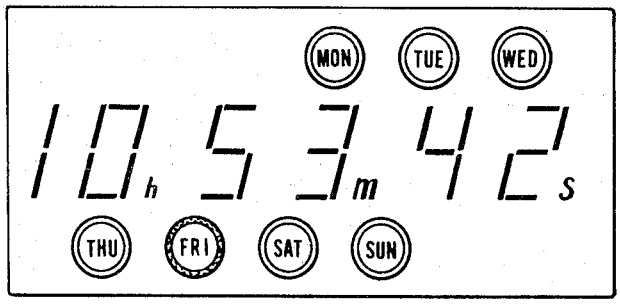
FIG. 1 shows an example of the days of the week indicated by a conventional photoelectric display device, Friday being displayed.
Figure 2:
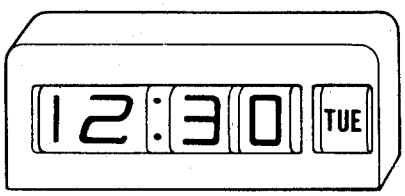
FIG. 2 shows another example of the days of the week indicated by a conventional drum-type display device.
Figure 3:
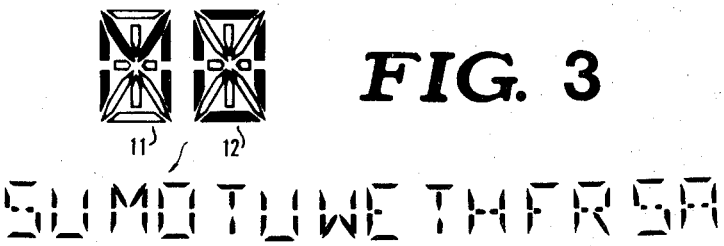
FIG. 3 shows an example of the days of the week indicated by conventional segments.
Figure 4:
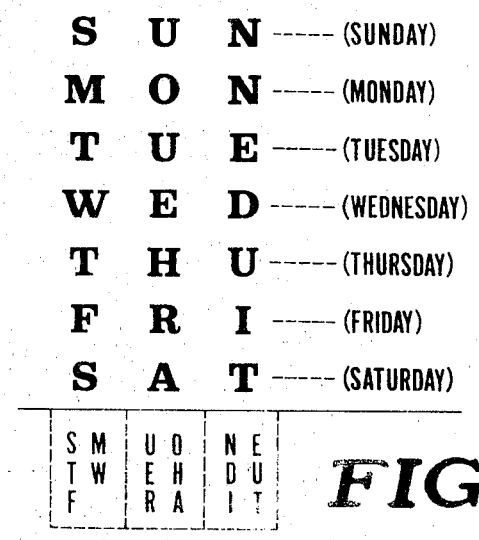
FIG. 4 shows alphabetical letters necessary for indicating the days of the week in English.

Each of the array display segments described in the above examples is composed of 7 to 10 independent segments. As a result, the invention significantly reduces the number of segments when compared with 14 segments required for the conventional display device shown in FIG. 3.

Moreover, the invention permits making the letters and digits in their natural forms and reducing the number of terminals to be connected to a time-counter circuit.

In addition, in the display device for use with a light-receiving element such as liquid crystal and the like, enlargement of the segment in its width and area is required in order to obtain a distinct indication contrary to the use of a light-emitting element.

From that point of view, the reduction in the number of segments according to the invention is considerably effective in obtaining a distinct indication of the numerical digits and alphabetical letters.

In addition, in the display device using the light-receiving element such as liquid crystal and the like, it is necessary to lead out wires from the segment electrodes. If the number of segments becomes large, a difficulty arises in leading out of the electrodes and in wiring on the electrode substrate for connecting the lead wires to the time-counter circuit. From this point of view, the reduction in the number of segments is advantageous with respect to the wiring on the electrode substrate and in the connections of the lead wires to the time-counter circuit.

Figure 8B:
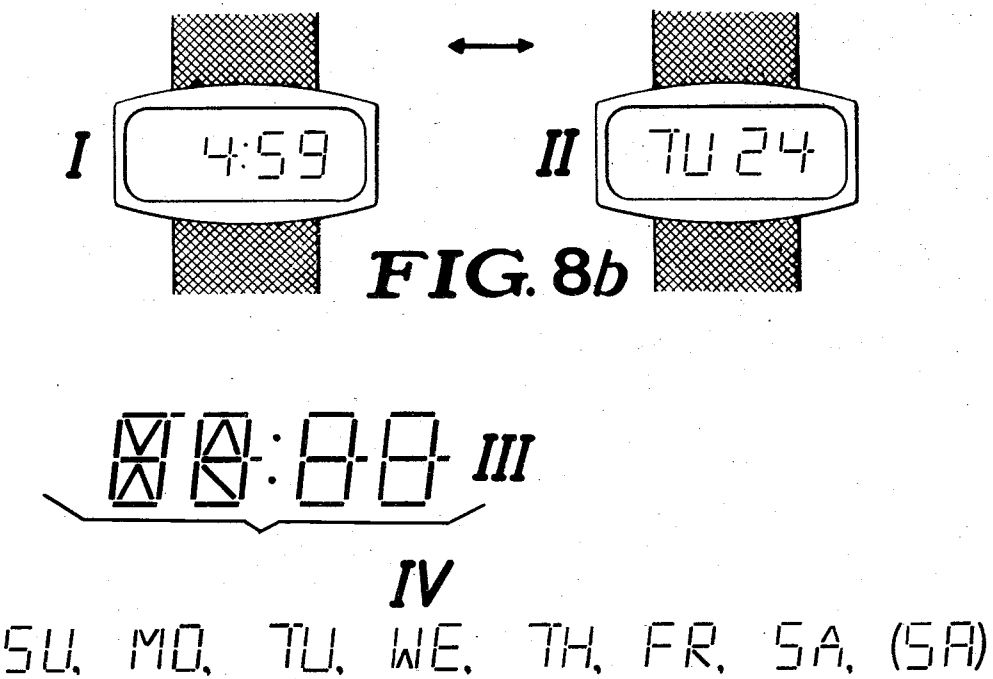
Figure 8C:
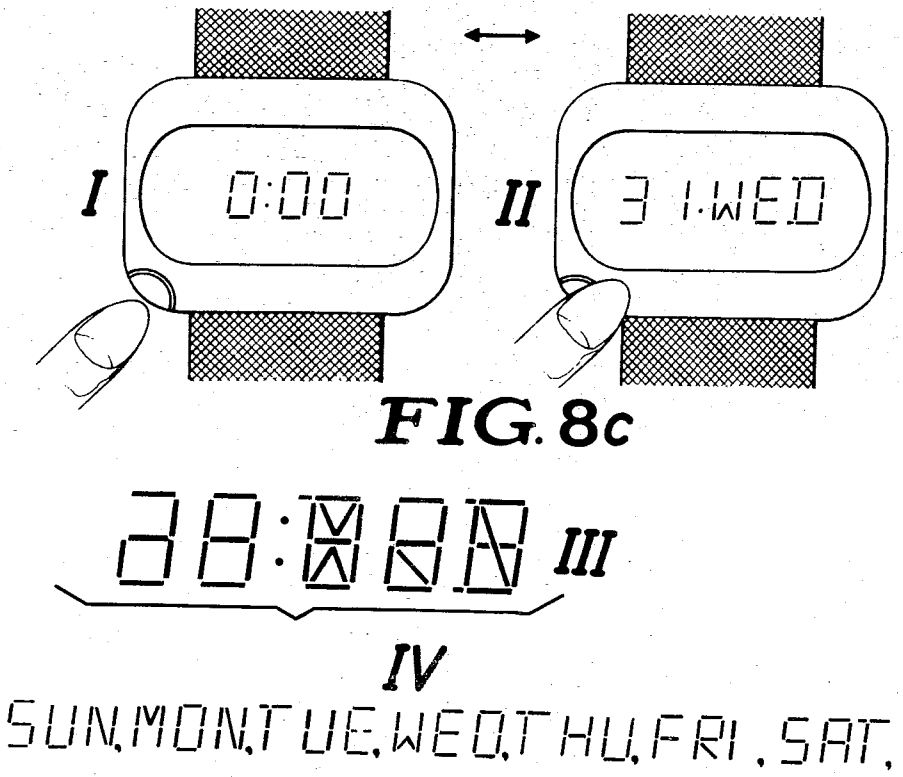

When using the device of the invention in timepieces for indicating the days of the week, the display segments indicating only the alphabetical letters can also indicate the date, days of the week and time as shown in FIG. 7, while the display segments indicating both the numerical figures and the alphabetical letters can also indicate the date, days of the week and time as shown in FIGS. 8*a*, 8*b* and 8*c*.

In FIG. 8*a* I there is shown a wrist watch to indicate the time. In FIG. 8*a* II a wrist watch is shown indicating the date and the days of the week. In FIG. 8*a* III there is shown the construction of the segments of each display element. In FIG. 8*a* IV there is shown the letters of the days of the week. The changeover between the date and the days of the week may be effected by a manually operated switch 29 as seen in FIGS. 8*c* I and 8*c* II, or may automatically be effected as seen in FIGS. 8*a* and 8*b*. The wrist watch shown in FIG. 8*a* I indicates 4 hours 59 minutes and 13 seconds. The wrist watch shown in FIG. 8*a* II indicates December 16 and Friday. The wrist watch shown in FIG. 8*b* I indicates 4 hours 59 minutes. The wrist watch shown in FIG. 8*b* II indicates Tuesday and 24th day. The wrist watch shown in FIG. 8*c* I indicates 0 hours 00 minute. The wrist watch shown in FIG. 8*c* II indicates 31st day and Wednesday.

In FIG. 9 are shown examples of the segments electrodes and lead electrodes for use with the liquid crystal display cell.

In FIG. 10*a* is shown another embodiment of the display body consisting of the three arrays of display segments of the display device according to the invention. The display body of the present embodiment is composed of a first array of display segments consisting of 10 segments, a second array of display segments consisting of seven segments, and a third array of display segments consisting of nine segments and constitutes a display device for indicating the days of the week in French.

The segments of each of these three display arrays are energized by electric control signals transferred from a timepiece circuit every 24 hours as shown in FIG. 10*b*, thereby indicating the days of the week in French by three alphabetical letters.

Particularly, in the display body shown in FIG. 10*a*, a display segment 31 of the first array composed of 10 segments is curved upwardly at its right side in order to make the letters D and J look like their natural forms, respectively. In addition, the first array has a display segment 32 added thereto in order to make the alphabetical letter M balanced on its left and right sides and has a segment 32 added thereto in order to make the letter J look natural.

In FIG. 11*a* there is shown another display body constructed on the basis of seven segments and capable of indicating the numerical digits, days of the week, dates, times and the like in French.

The alphabetical letter display body shown in FIG. 11*a* is made larger in the number of segments than the alphabetical letter display body shown in FIG. 10*a* for the purpose of indicating the numerical digits.

The alphabetical letters D, L, J and V indicated by the first array of display segments shown in FIG. 11*a* are different from those indicated by the first array of display segments shown in FIG. 10*a*.

In FIG. 12*a* there is shown an alphabetical letter display body having a first array of display segments consisting of 18 segments and for indicating the time and the days of the week in French.

The alphabetical letter display body shown in FIG. 12*a* is composed of a first array of segments consisting of 18 segments, a second array of display segments consisting of seven segments and a third array of display segments consisting of 10 segments. In the alphabetical letter display body shown in FIG. 12*a*, both the segments 51 and 52 are simultaneously illuminated and extinguished, while the segments 53 and 54 are also simultaneously illuminated and extinguished.

Figures 12B, 12C:
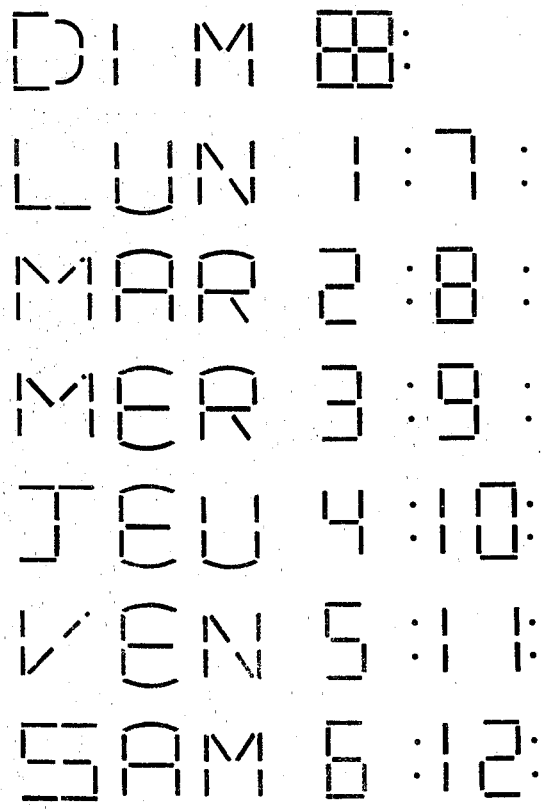

In FIG. 12*b* we show the days of the week indicated by the alphabetical display body of FIG. 12*a*. In this case, colon-indicating points 55 are extinguished. In FIG. 12*c* there are shown examples of the time indicated by the alphabetical display body of FIG. 12*a*.

In FIG. 13*a* we show an alphabetical letter display body composed of a first array of display segments as in FIG. 12*a* and supplemented with a segment 61, a second array of display segments as in FIG. 12*a* and supplemented with a segment 62, and a third array of segments as in FIG. 12*a* and supplemented with a segment 63. The alphabetical letter display body shown in FIG. 13*a* is capable of indicating the alphabetical letters W, R and T and of changing over the indication of the days of the week from English to French and vice versa.

Thus, the use of the display body shown in FIG. 13*a* ensures not only the indication of the days of the week in French as shown in FIG. 12*b* and the indication of the time as shown in FIG. 12*c*, but also the indication of the days of the week in English as shown in FIG. 13*b*.

In FIGS. 14*a* and 14*b* there is shown an example of a wrist watch provided with the display device of FIG. 12*a*.

The wrist watch usually indicates the time as shown in FIG. 14*a*. when a changeover switch is pushed, the days of the week are indicated in French as shown in FIG. 14*b*.

In FIG. 15 we show another example of the wrist watch which can indicate the time and the days of the week separately. In the present example, use is made of the display device of FIG. 10*a* to indicate the days of the week as shown by reference numeral 81.

Figure 16A:
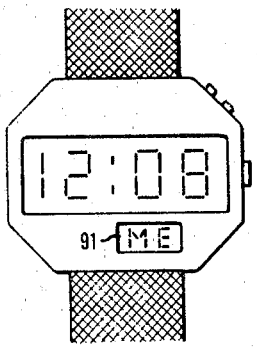
Figure 16B:
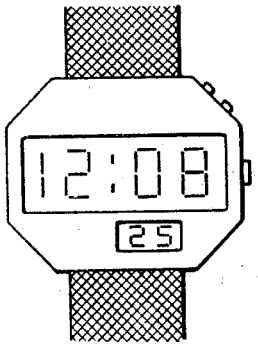

In FIGS. 16*a* and 16*b* there is shown another example of the wrist watch which makes use of the alphabetical letter display body of FIG. 12*a* and which can shift from indicating the days of the week in French to indicating the numerical digits and vice versa. The days of the week are indicated by two letters. FIG. 16*a* shows 12 hours 8 minutes and Wednesday in French, while FIG. 16*b* shows 12 hours 8 minutes and 25th day. In the present example, a display device 91 can change from the indication of the days of the week in French to the indication of the date and vice versa. That is, if an additional changeover switch is pushed, the indication of the days of the week in French as shown in FIG. 16*a* is shifted to the indication of seconds as shown in FIG. 16*b*. FIG. 16*b* shows 12 hours 8 minutes 25 seconds. Thus, the present example is capable of constituting a time-counter circuit.

In FIG. 17*a* there is shown an example of the display body indicating the days of the week in German. FIG.

17*b* shows examples of the days of the week indicated by the display body of FIG. 17*a*.

In FIG. 18*a* we show another example of the display body constructed on the basis of seven segments and which can indicate the days of the week in German and the numerical digits such as the dates, times and the like.

In the display body shown in FIG. 18*a*, to the first display element is added a segment 121 in order to distinguish D from O. Such distinction between D and O is shown by DIE and DON in FIG. 18*b*.

In FIG. 19*a* there is shown an example of the display body which can indicate the days of the week in Italian. FIG. 19*b* shows examples of the days of the week indicated by the display body of FIG. 19*a*. A segment 131 of the first display element shown in FIG. 19*a* is energized when an alphabetical letter D is indicated so as to discriminate D from O as in DOM in FIG. 19*b*.

In FIG. 20*a* we show Italian language versions composed of four to six alphabetical letters. FIG. 20*b* shows an example of a display body which is composed of six display segments indicating these Italian versions of FIG. 20*a*. In the present example, the first three display elements *a* to *c* are the same as those shown in FIG. 19*a*. The fourth display element designated by *d* is constructed so that it indicates alphabetical letters E, T, C, V and O. The fifth display element designated by *e* is constructed so that it indicates alphabetical letters N, E, O, R, and T. The last display element designated by *f* is constructed so that it indicates the alphabetical letters I, L and O. The display elements *e* and *f* are distinguished when four letters such as LUNE, which is short for LUNEDI or Monday in Italian, are indicated.

In FIG. 21*a* we show an example of the display body which can indicate the days of the week in Portuguese. FIG. 21*b* shows examples of the days of week indicated by the display device of FIG. 21*a*.

In FIG. 22*a* there is shown an example of the display body which can indicate the days of the week in Spanish. The pattern of the display body shown in FIG. 22*a* is just the same as that of FIG. 10*a* which can indicate the days of the week in French. As a result, it is possible to construct the circuit such that the days of the week indicated in Spanish are changed over to the days of the week indicated in French and vice versa.

When indicating the days of the week in Spanish, electric control signals are transmitted such that the days of the week are energized as shown in FIG. 22*b*.

In FIG. 23*a* there is shown an example of the display body which can indicate the days of the week in Dutch. FIG. 23*b* shows examples of the days of the week indicated by the display body of FIG. 23*a*.

In FIG. 24*a* we show an example of the display body which can indicate the days of the week in Swedish. FIG. 24*b* shows examples of the days of the week indicated by the display body of FIG. 24*a*.

In FIG. 25*a* there is shown an example of the display body which can indicate the days of the week in Russian. FIG. 25*b* shows examples of the days of the week indicated by the display body shown in FIG. 25*a*.

In FIG. 26*a* we show an example of the display body which can indicate the days of the week in Finnish. FIG. 26*b* shows examples of the days of the week indicated by the display body of FIG. 26*a*.

The changeover display bodies which can shift from the days of the week indicated in French to indications in time have been described with reference to FIGS. 11*a*, 12*a* and 13*a*. The changeover display body which can shift from the days of the week indicated in German into the time indications has been described with reference to FIG. 18*a*. It may easily be conceived to construct any other changeover display bodies on the basis of the seven display segments shifting from the days of the week indicated in any other national languages to indications in numerical digits.

The changeover display body which can effect turnover between the days of the week indicated in English and those indicated in French has been shown in FIG. 13*a*. It may also easily be conceived to construct any other changeover display bodies on the basis of the seven display segments which can effect turnover between the days of the week indicated in English and those indicated in German and between the days of the week indicated in English and those indicated in Spanish and the like.

Examples of the photoelectric display element of the above described photoelectric display device are a nixie tube, plasma display tube, fluorescent display tube, incandescent lamp, Braun tube, photodiode, miniature bulb, liquid crystal, PLZT ceramic, electrochromic and the like.

When desiring to use photodiodes or electric bulbs as the photoelectric display element, the display device is constructed such that the point light source consisting of the photodiode or electric bulb is enerigized so as to form a rod-shaped segment. As a result, the difficulty encountered when increasing the number of terminals for controlling the point light sources by electric signals and the like can be obviated.

The use of the liquid crystal or electrochromic as photoelectric display element is extremely suitable for the wrist watch and the like which must limit its power consumption and provides the important advantage that a display pattern of comparatively complex construction such as, for example, the first display element inclusive of the segments 51 and 52 as shown in FIG. 12*a*, can easily be constructed.

In the display device using the above described display elements, a given day of the week, as for example, Sunday, can be indicated for distinguishing it from the other days of the week in a way to be described.

If use is made of photodiodes or electric bulbs as the photoelectric display element, each of the segments energized when Sunday is to be indicated is composed beforehand of two light-emitting bodies. One of these light emitting bodies is used to indicate Sunday in the usual manner, while the other light-emitting body is passed through a filter and the like so as to emit red light when Sunday is indicated.

If use is made of liquid crystal as the photoelectric display element, it is possible to effect the display pattern in an up-down manner. That is, when Sunday is to be indicated, the upper part of this indication is moved down contrary to the indication of the other days of the week. Alternatively, it is possible to cause the display cell or display pattern to indicate Sunday in red color. Such selective indication may be performed by an electric control system.

As stated hereinbefore the photoelectric display device which, according to our invention, can indicate alphabetical letters by means of a comparatively small number of display segments and the days of the week in various national languages abbreviated in form, has the advantages that (1) the days of the week can be indicated in a small space and in good design, (2) the indication can be effected by means of a comparatively small number of display segments so that, as a result, a display distributor circuit for a time counter circuit can easily be manufactured, terminals connected to circuits can be made small in number, and the display device can be manufactured in a simple and easy manner, and (3) changeover between the days of the week indicated in one national language and the numeral digits indicated on the days of the week indicated in another national language or different dialects can be effected by adding a small number of display segments.

What is claimed is:

1. A device for displaying at least the initials of the days of the week, comprising:

a first array of electrically controllable elongate display elements selectively energizable in different combinations corresponding to the first letter of any day of the week; and a second array of electrically controllable elongate display elements selectively energizable in different combinations corresponding to the second letter of any day of the week;

said elements of said first and said second arrays including six linear elements forming an oblong substantially upright frame and a seventh linear element extending horizontally across said frame to divide same into an upper and a lower half, said first array further including two V-shaped elements disposed in said halves in mutually inverted relationship with vertices pointing toward said seventh element, said second array further including an eighth linear element extending obliquely from upper left to lower right within said lower half.

2. A photoelectric device as defined in claim 1, further comprising switch means for displaying different characters by varying the combination of selectively energized elements in each array.

3. A device as defined in claim 1 wherein said display elements are liquid-crystal segments.

* * * * *